US005996583A

United States Patent [19]

King

[11] Patent Number: 5,996,583

[45] Date of Patent: Dec. 7, 1999

[54] STERNUM THORACIC ELEVATED FULCRUM UNIT

[76] Inventor: Wallace E. King, 2401 S. Washington, Grand Forks, N. Dak. 58201

[21] Appl. No.: 09/175,313

[22] Filed: Oct. 20, 1998

[51] Int. Cl.[6] ..... A61G 15/00

[52] U.S. Cl. ..... 128/845; 128/846; 5/630; 5/632

[58] Field of Search ..... 128/845, 846; 5/630, 632, 652, 725, 638

[56] References Cited

U.S. PATENT DOCUMENTS

| | | | |
|---|---|---|---|
| 3,747,916 | 7/1973 | Benson | 5/725 |
| 3,890,004 | 6/1975 | Rail | 5/652 |
| 4,596,384 | 6/1986 | Blosser | 5/725 |
| 4,969,222 | 11/1990 | Serola | 5/630 |
| 5,297,303 | 3/1994 | Stafford | 5/632 |

*Primary Examiner*—Michael A. Brown
*Attorney, Agent, or Firm*—Thelen Reid & Priest LLP

[57] ABSTRACT

A chiropractic device having front and rear portions, a central semi-circular raised portion extending upwardly from the upper surface of the device and notches formed in the sides of the front portion of the device. A patient rests his or her torso on the device by placing his or her sternum on the central semi-circular raised portion of the device. The device has first and second sides, each side having a front side portion, a middle slanted side portion extending outwardly from the front side portion to define a notch in the front portion of the device, and a rear side portion. The patient's arms are accommodated by the notches formed in the sides of the front portion of the device. The central raised portion places the patient in a superior position for treatment and protects the patient's chest from being pressed against the upper surface of the device during treatment.

17 Claims, 4 Drawing Sheets

FIG. 2
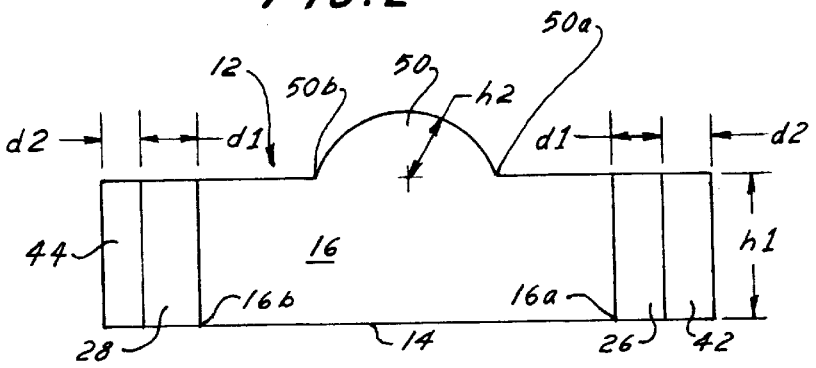
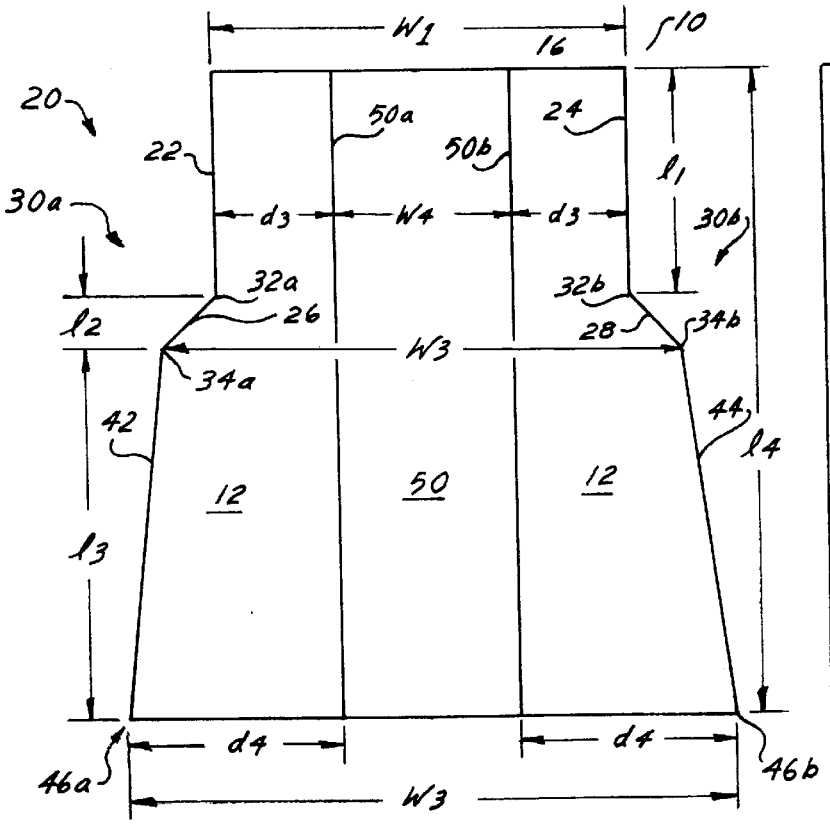
FIG. 3
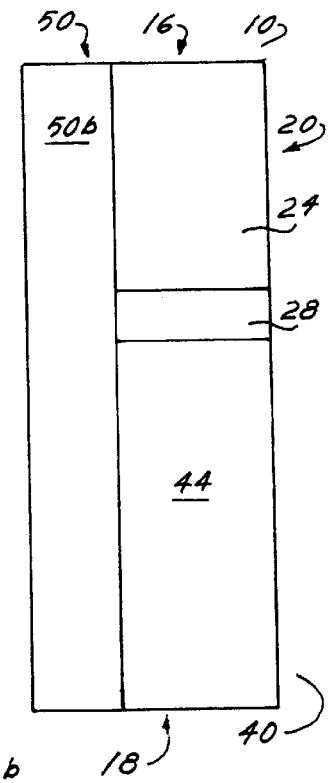
FIG. 4

STERNUM THORACIC ELEVATED FULCRUM UNIT

BACKGROUND OF THE INVENTION

1. Field of the Invention

The present invention relates to a chiropractic device. More specifically, the invention relates to a chiropractic device having a raised, rounded, portion (or fulcrum) providing bilateral leverage for supporting a patient during chiropractic treatment.

2. Related Art

Chiropractic tables and devices are well known. For example, U.S. Pat. No. 4,559,930 to Cobiski teaches a therapeutic bench comprising an elongated, horizontal support having a shorter thoracic cage cushion support thereon which supports only a patient's sternum and chin. The cushion includes a notch to accommodate the patient's chin and head.

U.S. Pat. No. 5,224,956 to Dumas et al. teaches a device having side buttressing and an adjustable width for aligning a patient's spine. U.S. Pat. No. 4,838,249 to Jannotta teaches an apparatus including a cushion for supporting a patient's thorax and abdomen. A restraint element bears against the patient's thighs to hold his or her body in position.

U.S. Pat. No. 3,747,916 to Benson teaches a chiropractic table having a raised area to place proper stresses on the spine to aid in adjustment. U.S. Pat. No. 1,710,400 to Bebout teaches a chiropractic table having a pair of arched folding cushions. U.S. Pat. No. 1,684,459 to Spilman teaches a planar chiropractic table covered with a group of pneumatic tubes that, when inflated, provided the desired stress or tension on a patient's spine.

None of these patents teaches providing a chiropractic device having a central raised portion that provides bilateral leverage to a patient. A central raised portion provides support for a patient's sternum and protection for the patient's chest, in particular a female patient's breasts, during treatment. It is therefore desirable to provide a chiropractic device having a central raised portion which provides a fulcrum to compound a posterior bi-lateral traction release; reciprocal to posterior spinal-rib articulations subluxation release/correction.

SUMMARY OF THE INVENTION

Other objects, features and advantages of the present invention will be apparent to those skilled in the art upon a reading of this specification including the accompanying drawings. The present invention is a chiropractic device having front and rear portions and a central raised portion (or fulcrum) running along the length of the device to provide leverage to a patient during treatment. Preferably, the device has notches formed at the sides of its front portion that are configured to allow a patient's arms to comfortably hang vertically downward from the sides of the device.

The central raised portion is configured to support a patient's sternum during chiropractic treatment. Preferably, the central raised portion has a semi-circular cross-section. It protrudes upwardly from the top surface of the device and extends along the center length of the device.

The inventive device is intended to replace the horizontal planar chest support platform unit of conventional chiropractic tables and benches. It can be used in combination with a support, such as a chiropractic bench or table, or formed integrally with such a support. During treatment, a patient lies face-down on the table with his or her face and head resting on a head piece, such as bilateral cheek rests, provided at the front portion of the support, his or her sternum resting on the central raised portion of the device provided at the middle portion of the support and his or her legs resting on the rear portion of the support. The patient's arms hang vertically downward from the device.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 2 illustrates a front plan view of the inventive chiropractic device;

FIG. 3 illustrates a top plan view of the inventive chiropractic device;

FIG. 4 illustrates a side plan view of the inventive chiropractic device.

DETAILED DESCRIPTION OF THE PREFERRED EMBODIMENTS

Figure 1:
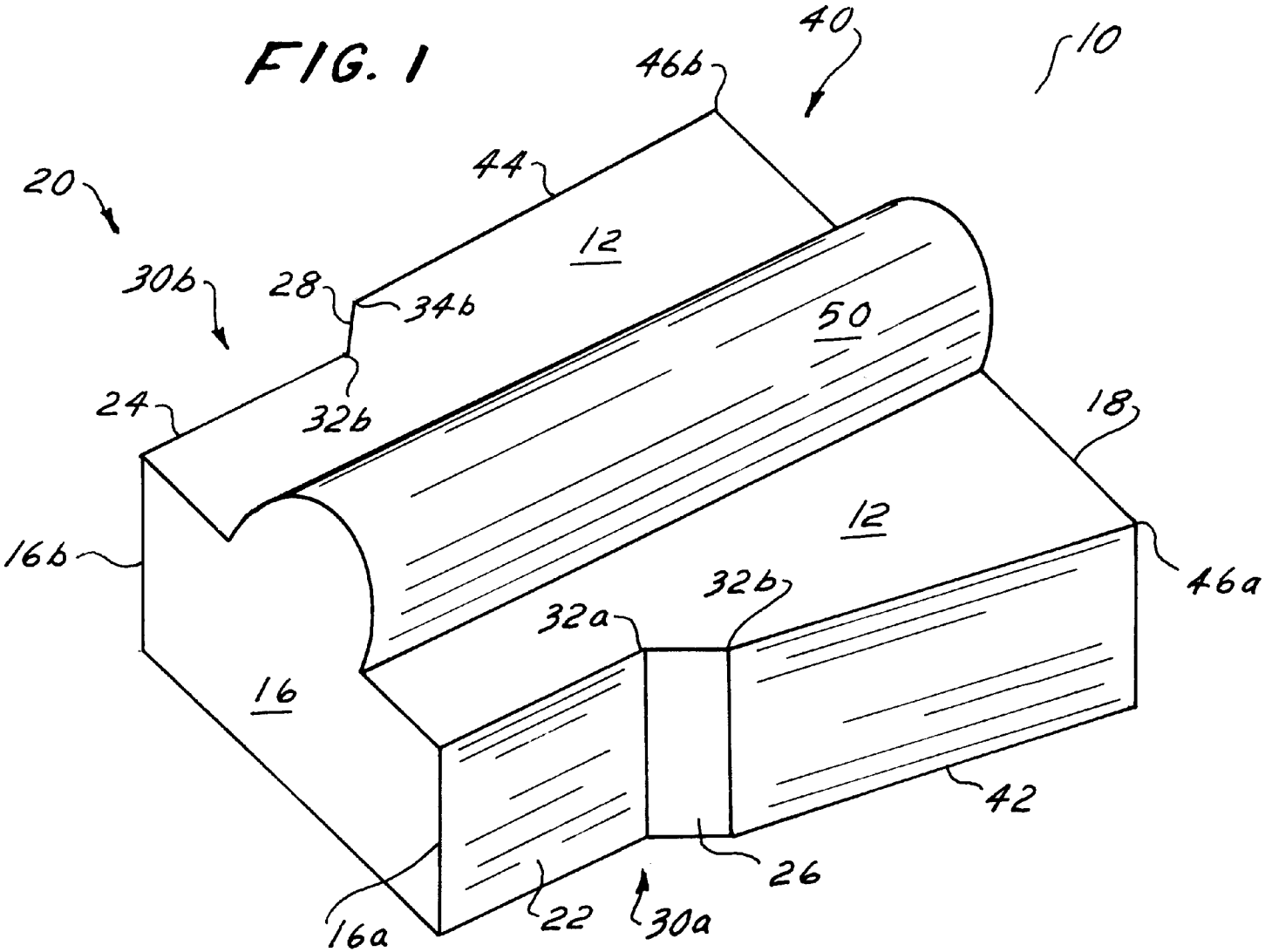
FIG. 1 illustrates a perspective view of the inventive chiropractic device.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 3A:
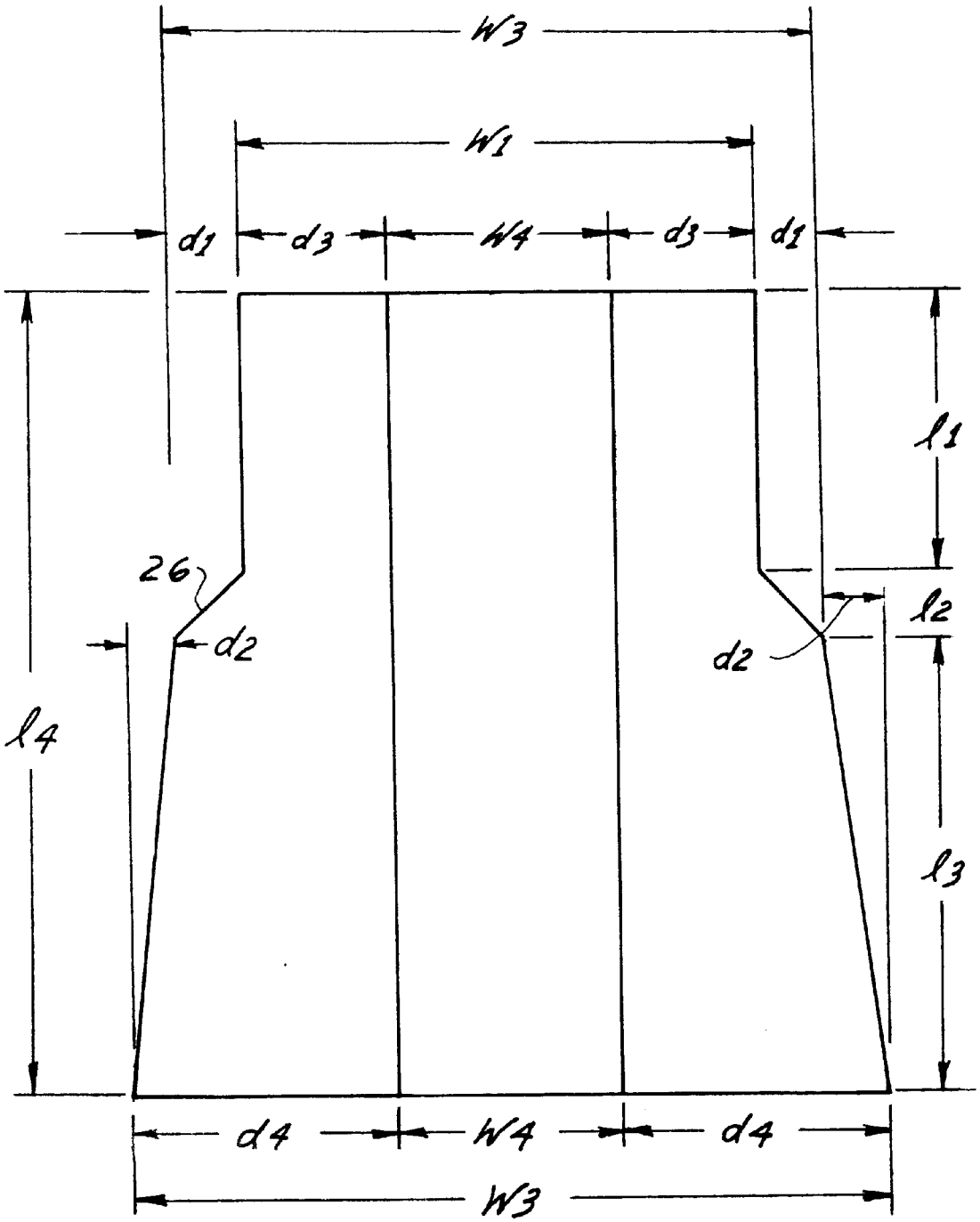
FIG. 3A is a top plan view of the inventive chiropractic device showing various lengths, widths, heights and distances.

As illustrated in FIGS. 1 and 3A, the inventive chiropractic device 10 has a predetermined length $l_4$ and includes upper and lower surfaces 12, 14, front and rear faces 16, 18, front and rear portions 20, 40 and a central raised portion (or fulcrum) 50 protruding upwardly from upper surface 12 and extending longitudinally along the center length of upper surface 12. Upper and lower surfaces 12, 14 and front and rear faces 16, 18 are preferably planar. Central raised portion 50 preferably has a semicircular cross-section. As described in detail below, during use lower surface 14 of device 10 is placed on a planar surface such as a chiropractic bench or table.

Preferably, the height $h_1$ of device 10 (the distance between upper and lower surfaces 12, 14 of device 10) is about 3 inches and the width $w_1$ of front surface 16 of device 10 (the distance between first and second front side portions 22, 24) is about 11 inches.

Front portion 20 of device 10 includes front surface 16, first and second front side portions 22, 24; first and second slanted front side portions 26, 28; first and second inner notch corners 32*a*, 32*b*; and first and second outer notch corners 34*a*, 34*b*. Front surface 16 is preferably rectangular. First and second front side portions 22, 24 are preferably rectangular and first and second slanted front side portions 26, 28 are preferably rectangular.

As shown in FIG. 3A, the distance $d_1$, (1) between first side 16*a* of front surface 16 of device 10 and first outer notch corner 34*a* and (2) between second side 16*b* of front surface 16 of device 10 and second outer notch corner 34*b* is preferably about 1½ inches.

As illustrated in FIGS. 1, 2, 3 and 3A, first and second slanted front side portions 26, 28 extend outwardly from first and second front side portions 22, 24 at an angle, forming first and second inner notch corners 32*a*, 32*b*. First and second slanted front side portions 26, 28 are preferably slanted at an angle of about 45 degrees from first and second front side portions 22, 24. The length $l_1$ of first and second front side portions 22, 24 is preferably about 6 inches and the length $l_2$ of first and second slanted front side portions 26, 28 is preferably about 2⅛ to 3 inches.

First and second rear side portions 42, 44, discussed in detail below, are connected to first and second slanted front side portions 26, 28 at first and second outer notch corners 34*a*, 34*b*. First and second rear side portions 42, 44 extend outwardly from first and second outer notch corners 34*a*, 34 to first and second rear corners 46*a*, 46*b*, preferably at an angle of about 5 degrees. The distance $w_2$ between first and second outer notch corners 34*a*, 34*b* is preferably about 14 inches.

As shown in FIG. 3A, the distance $d_2$ (1) between first outer notch corner 34*a* and first rear corner 46*a* and (2) between second outer notch corner 34*b* and second rear corner 46*b* is preferably about 1 inch.

Thus, first and second side portions 22, 24 are spaced apart from and connected to first and second rear side portions 42, 44 by first and second slanted side portions 26, 28. First and second front side portions 22, 24, first and second slanted front side portions 26, 28, first and second inner notch corners 32*a*, 32*b* and first and second outer notch corners 34*a*, 34*b* define first and second notches 30*a*, 30*b* in upper portion 20 of device 10. As described in detail below, first and second notches 30*a*, 30*b* allow a patient to comfortably rest his or her arms along the sides of device 10 during treatment.

Rear portion 40 of device 10 includes first and second rear side portions 42, 44 and first and second rear corners 46*a*, 46*b*. First and second rear side portions 42, 44 are preferably rectangular, and preferably extend from outer notch corners 34*a*, 34*b* to first and second rear corners 46*a*, 46*b* at an angle of about 5 degrees.

The length $l_3$ of first and second rear side portions 42, 44 is preferably about 9½ inches. The distance $w_3$ between first and second rear corners 46*a*, 46*b* is preferably about 16 inches and the total length 14 of device 10 is preferably about 17 inches.

As illustrated in FIGS. 1 through 5, central raised portion 50 is located in the center of device 10, runs along length $l_4$ of device 10, and protrudes upwardly from upper surface 12 of device 10. The height $h_2$ of central raised portion 50 is preferably about 2½ inches and the width $W_4$ of central raised portion 50 is preferably about 5 inches. Preferably, central raised portion 50 has a semi-circular cross-section to comfortably accommodate a patient's sternum.

As shown in FIG. 3A, the distance $d_3$ (1) between first front side portion 22 of front portion 20 of device 10 and first side 50*a* of central raised portion 50 and (2) between second front side portion 24 of front portion 20 of device 10 and second side 50*b* of central raised portion 50 is preferably about 3 inches. The distance $d_4$ (1) between first rear corner 46*a* of rear portion 40 of device 10 and first side 50*a* of central raised portion 50 and (2) between second rear corner 46*b* of rear portion 40 of device 10 and second side 50*b* of central raised portion 50 is preferably about 5½ inches.

Device 10 is preferably formed of high density plastic foam, rubber or cotton padding or any other suitable material that is firm enough to prevent loss of the convex shape of central raised portion 50 and is comfortable for the patient. Device 10 is preferably covered with durable comfortable material such as heavy duty leather, NAUGAHYDE, vinyl or thick fabric.

Figure 5:
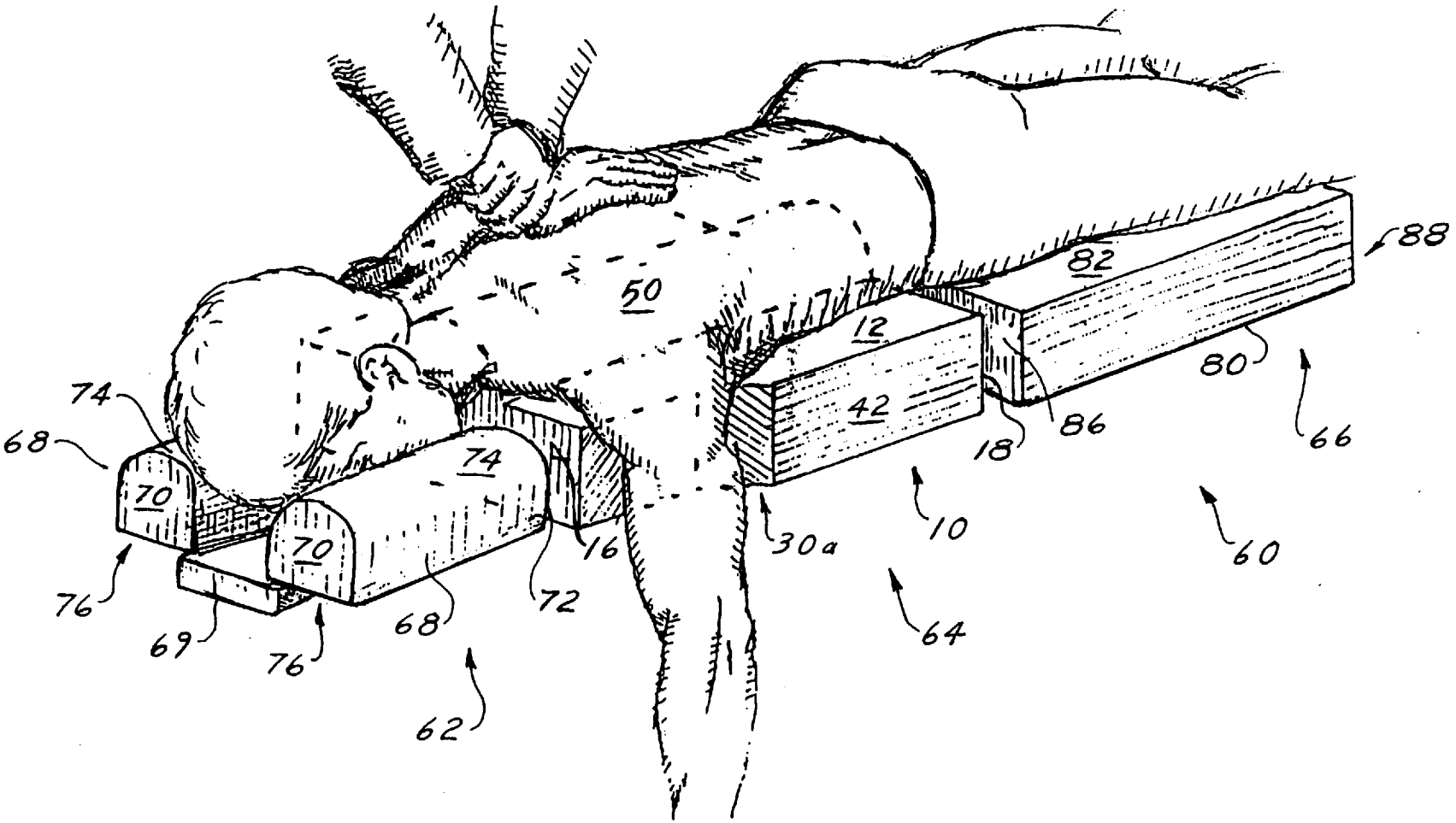
FIG. 5 illustrates a perspective view of the inventive chiropractic device formed integrally with a support bench.

As shown in FIG. 5, device 10 can be used in combination with or formed integrally with a conventional support 60, such as a chiropractic bench or table as follows. Support 60 has a front portion 62, a middle portion 64 and a rear portion 66. Parallel bilateral cheek rests 68 are attached to a central horizontal support 69 at front portion 62 of support 60 and protrude vertically upwardly therefrom. Preferably, cheek rests 68 are semicircular and include front face 70 and rear face 72, upper surface 74 against which the patient's face and head rest and lower surface 76, at least a portion of which is attached to horizontal support 69.

Horizontal support 69 can be a planar rectangular board running along the center length of support 60, parallel horizontal bars running along the side lengths of support 60, or any other shape suitable for supporting bilateral cheek rests 68, device 10 and leg rest 80. Horizontal support 69 can be formed of any suitable material, such as plastic, metal or wood and can be covered with a durable protective covering, such as heavy duty leather, NAUGAHYDE, vinyl or thick fabric. Bilateral cheek rests 68 and leg rest 80 can be formed of any suitable material, such as high density plastic foam, rubber or cotton padding and can be covered with a comfortable, durable protective covering, such as heavy duty leather, NAUGAHYDE, vinyl or thick fabric.

Lower surface 14 of device 10 is attached to horizontal support 69 at middle portion 66 of support 60 so that front face 16 of device 10 is located adjacent rear face 72 of bilateral cheek rests 68 and rear face 18 of device 10 is adjacent front face 86 of leg rest 80.

Leg rest 80 is preferably rectangular and has an upper surface 82, lower surface 84, front face 86 and rear face 88. Lower surface 84 of leg rest 80 is attached to horizontal support 69 at rear portion 66 of support 60 so that front face 86 of leg cushion 80 is located adjacent rear face 18 of device 10.

A patient lies face-down on support 60 with his or her face and head resting on upper surface 74 of bilateral cheek supports 68, his or her torso resting on upper surface 12 of device 10 and his or her legs resting on upper surface 82 of leg support 80. The patient's sternum is leveraged by the upwardly protruding central portion 50 of device 10. The patient's arms are preferably positioned so that they hang vertically downwardly from the patient's body and device 10 at notches 30*a* and 30*b*, as illustrated in FIG. 5.

Device 10 supports the patient's sterno-costo area as follows. Central raised portion 50 supports the patient's sternum by providing bilateral leverage and places the patient in a desirable position for adjusting the patient's vertebrae. During treatment, a doctor applies thrust (spino-costo articulation subluxation) to the patient. Central portion 50 supports the patient's sternum during such anterior spino-costo articulation subluxation and provides bilateral leverage to the patient. The bilateral leverage separates the patient's ribs allowing improved posterior rib articulation subluxation. Central portion 50 also prevents too much pressure from being exerted on the patient's chest. Lateral traction movement during treatment corrects the anterior rib/transverse subluxation mal position and thereby reduces and corrects spinal nerve modification and interference.

The bilaterally leveraged patient position and resulting rib separation allows posterior rib articulation subluxation superior to that achieved when the patient is in a horizontal prone position using conventional planar chiropractic tables or a semi-prone position using tapered chiropractic tables, such as that taught by Cobiski. The conventional horizontal prone and semi-prone patient positions do not provide bilateral leverage to the patient, do not separate the patient's ribs for posterior rib articulation subluxation and do not prevent exertion of excess pressure on the patient's chest. Thus, the conventional horizontal and semi-prone patient positions can result in excess pressure being exerted on the patient's chest, causing soft and/or hard tissue injury.

In particular, central raised portion 50 elevates a female patient's chest from upper surface 12 of device 10. This protects her breasts from being pressed against upper surface 12 of device 10 during treatment, thus maximizing the patient's comfort during treatment and preventing soft tissue injury. As discussed above, the conventional horizontal prone and semi-prone patient positions using conventional devices do not protect a patient's chest or a female patient's breasts from excess pressure during treatment which can cause soft tissue injury.

Modifications and variations of the above-described embodiments of the present invention are possible, as appreciated by those skilled in the art in light of the above teachings. For example, the dimensions of device 10 may be altered to accommodate smaller patients, such as children, or taller or larger overweight patients. It is therefore to be understood that, within the scope of the appended claims and their equivalents, the invention may be practiced otherwise than as specifically described.

What is claimed is:

1. A chiropractic device having a predetermined length comprising:

a front portion and a rear portion, each having an upper surface and a lower surface;

first and second sides;

each of said first and second sides having a front portion, a middle portion and a rear portion;

wherein said front portion of each of said first and second sides is connected to and spaced apart from said rear portion by said middle portion; and a central raised portion protruding upwardly from said upper surface and extending along the length of said device;

wherein said central raised portion supports a patient's sternum and provides bilateral leverage to the patient when the patient lies prone on said chiropractic device.

2. The chiropractic device of claim 1, wherein said central raised portion is semi-circular in cross-section.

3. The chiropractic device of claim 1, wherein said middle portion of said device extends outwardly from said front portion of each of said first and second sides to define first and second notches formed in said first and second sides of said front portion.

4. A chiropractic treatment method comprising the steps of:

providing a device having a predetermined length, an upper surface, a lower surface, a front portion, a rear portion, and a central raised portion protruding upwardly from the upper surface of the device and extending along the length of the device; and positioning a patient face-down on the device so that the patient's sternum rests against the central raised portion of the device;

wherein the central raised portion of the device provides bilateral leverage to the patient.

5. The chiropractic treatment method of claim 4, wherein the central raised portion is semi-circular in cross-section.

6. The chiropractic treatment method of claim 4, wherein the device has first and second sides, the first and second sides each being formed by a front side portion, a middle side portion and a rear side portion; the middle side portion extending outwardly from the front side portion to define a pair of parallel notches in the front portion of the device and connecting the front side portion to the rear side portion; and further comprising the step of:

positioning the patient's arms so that they hang vertically downwardly from the notches in the front portion of the device.

7. The chiropractic treatment method of claim 4, further comprising the steps of:

providing an elongated horizontal support having an upper surface and front, middle and rear portions;

positioning the device on the middle portion of the elongated horizontal support so that the lower surface of the device is adjacent the upper surface of the middle portion of the horizontal support; and positioning the patient face-down on the horizontal support so that the patient's sternum rests against the central raised portion of the device.

8. The chiropractic treatment method of claim 7, further comprising the step of:

positioning the patient so that the patient's face and head rest on the front portion of the elongated horizontal support and the patient's legs rest on the rear portion of the elongated horizontal support.

9. A chiropractic bench comprising:

an elongated horizontal support having front, middle and rear portions; and a chiropractic device having a predetermined length located on said middle portion of said elongated horizontal support, said device having an upper surface and a central raised portion protruding upwardly from said upper surface and extending along said length of said device;

wherein said central raised portion supports a patient's sternum and provides bilateral leverage to the patient when the patient lies prone on said chiropractic device.

10. The chiropractic bench of claim 9, wherein said central raised portion of said device is semi-circular in cross-section.

11. The chiropractic bench of claim 9, wherein:

said device has a front portion, a rear portion and first and second sides;

each of said first and second sides of said device being formed by a front side portion, a middle side portion and a rear side portion; and said middle side portion extending outwardly from said front side portion to define a pair of parallel notches in said front portion of said device and connecting said front side portion to said rear side portion.

12. The chiropractic bench of claim 9, further comprising:

a pair of parallel cheek rests located on said front portion of said elongated horizontal support and protruding vertically upwardly therefrom; and a leg rest located on said rear portion of said elongated horizontal support and protruding vertically upwardly therefrom.

13. A chiropractic device having a predetermined length comprising:

a front portion and a rear portion, each having an upper surface and a lower surface;

first and second sides;

each of said first and second sides having a front portion, a middle portion and a rear portion;

wherein said front portion of each of said first and second sides is connected to and spaced apart from said rear portion by said middle portion;

wherein said middle portion of said device extends outwardly from said front portion of each of said first and second sides to define first and second notches formed in said first and second sides of said front portion; and a central raised portion protruding upwardly from said upper surface and extending along the length of said device.

14. The chiropractic device of claim 13, wherein said central raised portion is semi-circular in cross-section.

15. A chiropractic bench comprising:

an elongated horizontal support having front, middle and rear portions; and a chiropractic device having a predetermined length located on said middle portion of said elongated horizontal support, said device having an upper surface and a central raised portion protruding upwardly from said upper surface and extending along said length of said device;

wherein said device has a front portion, a rear portion and first and second sides;

each of said first and second sides of said device being formed by a front side portion, a middle side portion and a rear side portion; and said middle side portion extending outwardly from said front side portion to define a pair of parallel notches in said front portion of said device and connecting said front side portion to said rear side portion.

16. The chiropractic bench of claim 15, wherein said central raised portion of said device is semi-circular in cross-section.

17. The chiropractic bench of claim 15, further comprising:

a pair of parallel cheek rests located on said front portion of said elongated horizontal support and protruding vertically upwardly therefrom; and a leg rest located on said rear portion of said elongated horizontal support and protruding vertically upwardly therefrom.

* * * * *